United States Patent [19]

Brownlee

[11] Patent Number: 4,842,051

[45] Date of Patent: Jun. 27, 1989

[54] RABBLE ARM USED IN MULTIPLE HEARTH FURNACE

[76] Inventor: David A. Brownlee, 2177 Stowe Dr., Springfield, Ohio 45505

[21] Appl. No.: 136,098

[22] Filed: Dec. 21, 1987

[51] Int. Cl.[4] ..... F28F 5/00

[52] U.S. Cl. ..... 165/93; 52/731

[58] Field of Search ..... 165/93; 52/720, 731, 52/738

[56] References Cited

U.S. PATENT DOCUMENTS

| | | | |
|---|---|---|---|
| Re. 12,254 | 8/1904 | Wright | 165/93 |
| 431,203 | 7/1890 | Dithridge | 52/738 |
| 1,079,405 | 11/1913 | Fowler | 165/93 |
| 1,687,935 | 10/1928 | Fowler | 165/93 |
| 2,925,893 | 2/1960 | Baas | 52/723 X |
| 4,007,574 | 2/1977 | Riddell | 52/722 |
| 4,211,179 | 7/1980 | Saunders | 114/90 |

FOREIGN PATENT DOCUMENTS

| | | | |
|---|---|---|---|
| 671372 | 9/1929 | France | 52/738 |

*Primary Examiner*—Samuel Scott
*Assistant Examiner*—Allen J. Flanigan
*Attorney, Agent, or Firm*—Stanley J. Price, Jr.; George Raynovich, Jr.

[57] ABSTRACT

A rabble arm adapted to be connected to a rotatable center shaft of a multiple hearth furnace includes an elongated tubular member having an open end portion and an opposite closed end portion. The tubular member has an outside surface of substantially oval cross-sectional configuration and an inside surface arranged to form a hollow interior portion connected with the tubular member open end portion. The oval cross-sectional configuration of the tubular member outside surface defines a tubular member major axis and a tubular member minor axis displaced from the major axis by substantially 90° C. A socket is connected to the tubular member open end portion. The socket and tubular member may include partitions or tubes which are connected upon assembly to form a flow path through the socket and tubular member for receiving a circulating cooling medium. The socket with the tubular member connected thereto forms a rabble arm which is adapted to be secured to a vertically extending center shaft of a multiple hearth furnace so that the tubular member is cantilevered to the center shaft with the tubular member minor axis positioned substantially horizontally.

5 Claims, 2 Drawing Sheets

RABBLE ARM USED IN MULTIPLE HEARTH FURNACE

BACKGROUND OF THE INVENTION

1. Field of the Invention

This invention relates to a rabble arm, and more particularly, to a rabble arm having an oval or elliptical cross-sectional configuration which allows the arm to be subjected to increased bending stresses within the heated interior of a multiple hearth furnace as the arm is operated to convey material within the furnace.

2. Description of the Prior Art

It is well known to utilize a high temperature furnace such as a multiple hearth furnace to heat or roast many types of material. The multiple hearth furnace includes a cylindrical outer shell with a plurality of vertically spaced hearths positioned therein. A vertical shaft extends through a central opening in each hearth. A plurality of rabble arms are connected to the vertical shaft in cantilever fashion, and the vertical shaft is rotated to allow the plurality of rabble arms to rotate within the interior of the furnace. The rabble arms hold a plurality of rabble teeth which contact the material being heated within the furnace, and the rabble teeth move the material positioned on a given hearth either towards the central opening or outside wall of the furnace.

Each rabble arm has a hollow interior which is connected to a hollow interior of the vertical shaft. A cooling medium, such as air under pressure, is passed through the hollow interior of the vertical shaft and is circulated through the hollow interior of each rabble arm to reduce the temperature of the arm. Cooling the interior of the rabble arm allows the arm to withstand higher bending stresses, since the limiting creep stress of the arm is inversely proportional to the temperature experienced by the arm. Since each rabble arm is connected to the furnace vertical shaft in cantilever fashion, each arm must be capable of supporting its own weight and the weight of the rabble teeth connected thereto at elevated furnace temperature. One type of failure of the rabble arm at elevated temperatures is predominantly due to sagging or bending vertically under its own weight and eventually breaking.

Rabble arms used in multiple hearth furnaces have heretofore been sand cast in one piece and have a hollow interior portion with a D-shaped cross-section turned 90° so that the planar surface of the arm lies horizontally. Rabble teeth are attached to the arm by either a dove tail or clevis-type connection. However, sand cast rabble arms having a D-shaped cross-section are relatively expensive to form, are extremely heavy, and are subject to all the manufacturing limitations of foundries such as core shift and shrink. These limitations all tend to weaken the sand cast arm and cause the arm to sag under its own weight over a period of time within the furnace. As the rabble arm sags, cracks develop between the air cooled interior and the outer wall of the arm to cause cooling air to leak into the furnace. Eventually, because of the progressive sagging of the rabble arm under its own weight the arm will be removed and replaced.

More recently, rabble arms have been made which utilize a circular, centrifugally cast alloy tube which is welded to a sand cast socket end. Rabble teeth holders are also welded longitudinally on the outer surface of the arm. The circular cross-sectional rabble arm construction offers some quality benefits, such as uniform tube wall thickness. However, the circular cross-sectional arm sacrifices strength due to the inherently weak circular cross-section of a tube.

U.S. Pat. No. 1,076,297 discloses an agitating or rabble arm for use in multiple hearth or roasting furnaces. The rabble arm has a center portion which is supported by a vertically extending center shaft within the furnace. The rabble arm extends radially from the center shaft on opposite sides of the shaft, and has a hollow interior for receiving a cooling medium. The portions of the rabble arm which extend radially from the center shaft each have a rectangular cross-sectional configuration which decreases from a location adjacent the center shaft to the end of the arm.

U.S. Pat. No. 1,444,209 discloses an ore roasting furnace which includes a plurality of rabble arms each having a D-shaped cross-sectional configuration turned 90° so that the planar surface of the arm lies horizontally and connected to a rotating shaft which extends vertically through the center of the furnace.

U.S. Pat. No. 1,687,935 discloses a rabble arm having a generally circular cross-sectional configuration which is connected to a rotating center shaft of a multiple hearth furnace. U. S. Pat. No. 2,332,387 discloses a rabble arm for use in a multiple hearth furnace which has a generally D-shaped cross-sectional configuration turned 90° .

U. S. Pat. No. 3,905,757 discloses an apparatus and method for distributing solid material over a plurality of vertically spaced hearths in a multiple hearth furnace. A rotatable center shaft extends vertically through the center of the furnace to pass through each hearth. Alternate hearths have drop holes disposed toward the center shaft and the other hearths have drop holes disposed towards the outer periphery thereof. A plurality of rabble arms are connected to the rotatable center shaft and have rabble teeth secured thereto which contact the solid material on each hearth. The rabble arms are illustrated as having a generally D-shaped cross-sectional configuration turned 90° so that the planar surface of the arm lies horizontally.

While the prior art suggests utilizing a rabble arm having either a circular, D-shaped or rectangular cross-sectional configuration, there is a need for an improved rabble arm which is connected to a rotating center shaft of a multiple hearth furnace. The improved rabble arm has an outside surface of substantially oval cross-sectional configuration to increase the rabble arm's resistance to sagging or bending vertically relative to a longitudinal axis of the arm when subjected to elevated temperatures over an extended period of time.

SUMMARY OF THE INVENTION

In accordance with the present invention, there is provided a rabble arm adapted to be connected to a center shaft of a multiple hearth furnace that includes an elongated tubular member having an open end portion and an opposite closed end portion. The tubular member has a outside surface of substantially oval cross-sectional configuration and an inside surface arranged to form a hollow interior portion connected with the tubular member open end portion. A socket having a hollow interior portion is connected to the tubular member open end portion so that the hollow interior portion of the socket is connected with the hollow interior of the tubular member. The socket with the tubular member connected thereto is adapted to be secured to a vertically extending center shaft of a multiple hearth furnace, and both the hollow interior of the socket and the hollow interior of the tubular member receive a cooling medium circulated therethrough.

Providing the rabble arm with an outside surface having a generally oval cross-sectional configuration and orienting the rabble arm in a predetermined position relative to the furnace center shaft increases the rabble arm's resistance to sagging or bending when exposed to elevated temperatures within the multiple hearth furnace over an extended period of time.

Accordingly, the principal object of the present invention is to provide a rabble arm adapted to be connected to a center shaft of a multiple hearth furnace which is relatively inexpensive to manufacture and has improved resistance to bending stresses over rabble arms previously used.

Another object of the present invention is to provide a rabble arm adapted to be secured to a center shaft of a multiple hearth furnace which has an outside surface of oval cross-sectional configuration.

A further object of the present invention is to provide a rabble arm having an outside surface of oval cross-sectional configuration which may be oriented in a predetermined position relative to the center shaft of a multiple hearth furnace to increase the arm's resistance to sagging or bending when exposed to elevated temperatures over an extended period of time.

These and other objects of the present invention will be more completely disclosed and described in the following specification, the accompanying drawings and the appended claims.

DESCRIPTION OF THE PREFERRED EMBODIMENT

Figure 1:
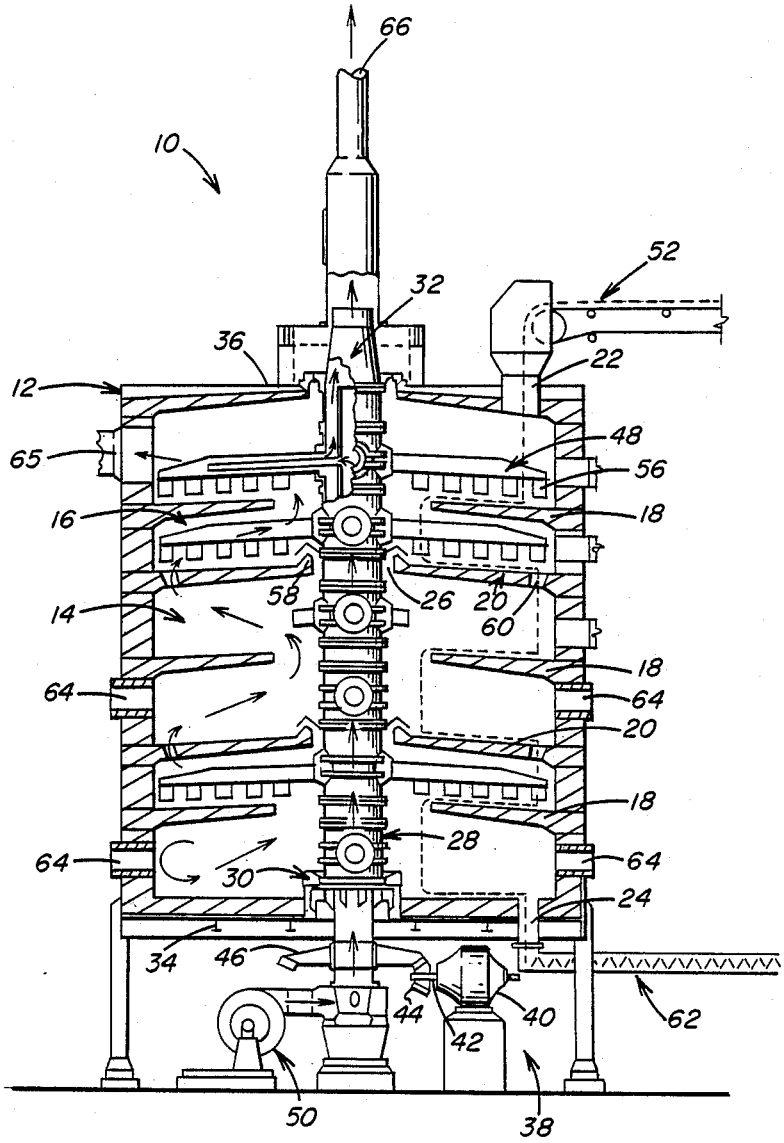
FIG. 1 is a partial sectional view in side elevation of a multiple hearth furnace, illustrating a rotatable shaft member extending vertically through the center of the furnace and a plurality of rabble arms which are the subject of this invention connected in cantilever fashion to the shaft member.

Referring to the drawings, and particularly to FIG. 1, there is illustrated a multiple hearth or roasting furnace generally designated by the numeral 10 for use in heating many types of material passed therethrough. Both the construction and operation of multiple hearth furnace 10 are themselves known in the art, and are described herein only as they pertain to the present invention. Multiple hearth furnace 10 is operable to heat or roast material by providing an internal atmosphere which permits intimate contact of the hot furnace drying gases and the material passed through the furnace.

As seen in FIG. 1, multiple hearth furnace 10 includes a cylindrical outer shell 12 which forms a hollow interior portion 14. A plurality of vertically spaced, individual hearths 16 are positioned within the hollow interior 14 of cylindrical outer shell 12. As known in the art, each hearth 16 may either be an in-hearth, such as in-hearth 18, or an out-hearth, such as out-hearth 20. As will be explained later in greater detail, a plurality of in-hearths 18 and out-hearths 20 are positioned within the hollow interior 14 of cylindrical outer shell 12 and vertically spaced in alternating fashion to provide a flow path for material passed through multiple hearth furnace 10 from furnace inlet opening 22 to furnace outlet opening 24.

Each in-hearth 18 and out-hearth 20 has a generally circular configuration, and has a central opening 26 to allow a vertical center shaft 28 to freely extend therethrough. Vertical center shaft 28 extends through the central openings 26 in each in-hearth 18 and out-hearth 20, and has a bottom shaft portion 30 and a top shaft portion 32 secured for rotational movement to the bottom and top walls 34, 36 of multiple hearth furnace 10, respectively.

Rotation of center shaft 28 within multiple hearth furnace 10 is accomplished by means of a rotating apparatus generally designated by the numeral 38. Rotating apparatus 38 includes a motor 40 having an output shaft 42. A bevel-type gear 44 is connected to output shaft 42, and engages a pinion-type gear 46 rigidly secured to center shaft 28. Rotation of center shaft 28 within multiple hearth furnace 10 in a preselected angular direction is accomplished by rotation of motor 40 output shaft 42. As motor 40 output shaft 42 is rotated, the bevel-type gear 44 is also rotated to turn pinion-type gear 46 and center shaft 28. Conversely, rotation of center shaft 28 in an opposite angular direction is accomplished by reversing the direction of rotation of motor 40 output shaft 42. It should be understood that although a specific rotating apparatus such as rotating apparatus 38 is illustrated and described herein, any suitable apparatus capable of rotating center shaft 28 within multiple hearth furnace 10 may be utilized without departing from this invention.

As further seen in FIG. 1, a plurality of rabble arms each generally designated by the numeral 48 are secured by suitable means to center shaft 28. As known in the art, both center shaft 28 and the plurality of rabble arms 48 have hollow interior portions, and a fan such as fan 50 is utilized to circulate a cooling medium such as air under pressure through the hollow interior portion of center shaft 28 and the hollow interior portion of each rabble arm 48. Since the interior portion 14 of multiple hearth furnace 10 is maintained at an elevated temperature to heat or roast material passed therethrough, the center shaft 28 and the plurality of rabble arms 48 must be cooled to prevent these components from experiencing heat damage due to these elevated temperatures.

In order to heat or roast material within multiple hearth furnace 10, the material to be heated is passed from a conveying system 52 into furnace interior portion 14 through furnace inlet opening 22. The flow path of material passed through furnace 10 interior portion 14 is schematically illustrated by a dotted line 54. As seen in FIG. 1, the material to be heated enters multiple hearth furnace 10 at inlet opening 22 and drops onto an in-hearth 18. As center shaft 28 is continuously rotated, the plurality of rabble arms 48 connected thereto are also rotated to allow a plurality of rabble teeth 56 connected to each rabble arm 48 because of their angle to direct the material towards central opening 26 of in-hearth 18. As the material is directed towards central opening 26, the material falls from in-hearth 18 onto an out-hearth 20 positioned directly beneath in-hearth 18. As seen in FIG. 1, each out-hearth 20 has an inner annular lip portion 58 which collects the falling material and prevents the material from passing through central opening 26. Material deposited on out-hearth 20 is directed by the tooth angle on the plurality of rotating rabble arms 48 towards an opening 60 in out-hearth 20. The material falling through out-hearth 20 opening 60 is deposited on an in-hearth 18 positioned directly beneath out-hearth 20. As described, material entering multiple hearth furnace 10 at furnace inlet opening 22 is passed over an alternating series of in-hearths 18 and out-hearths 20 by the rotating rabble arms 48. After the material is passed completely through multiple hearth furnace 10, the heated or roasted material is passed through furnace outlet opening 24 and onto a conveying system 62 for further processing on disposal.

As seen in FIG. 1, multiple hearth furnace 10 includes a plurality of openings 64 through which air at an elevated temperature, or other suitable heating medium, is introduced into the hollow interior 14 of multiple hearth furnace 10. This heated air effects drying or roasting of the material as the material is passed from furnace inlet opening 22 to furnace outlet opening 24. Suitable controls (not shown) are provided for regulating the temperature and pressure of the heated air introduced into furnace interior portion 14 to control the overall heating of the material passed through furnace 10. In addition, the speed of rotation of center shaft 28 and the angle of the teeth control the residence time of the material within furnace 10. After the heated air is passed through the interior 14 of furnace 10 to dry or roast the material therein, the heated air exits furnace 10 at heated air discharge opening 65 and is passed to a suitable air cleaning facility (not shown), such as a venturi scrubber or bag house facility. The air utilized to cool the interior of center shaft 28 and the plurality of rabble arms 48 exits multiple hearth furnace 10 at center shaft 28 discharge opening 66. The cooling air may either be vented to atmosphere or recirculated for further use.

In accordance with the present invention, there is provided an improved rabble arm 48 which is adapted to be connected to center shaft 28 and utilized to move material within multiple hearth furnace 10 as previously described. As will be described later in greater detail, the improved rabble arm 48 has an outside surface of substantially oval cross-sectional configuration to increase the rabble arm's resistance to sagging or bending vertically relative to a longitudinal axis of the arm when subjected to elevated furnace temperatures over an extended period of time.

Figure 2:
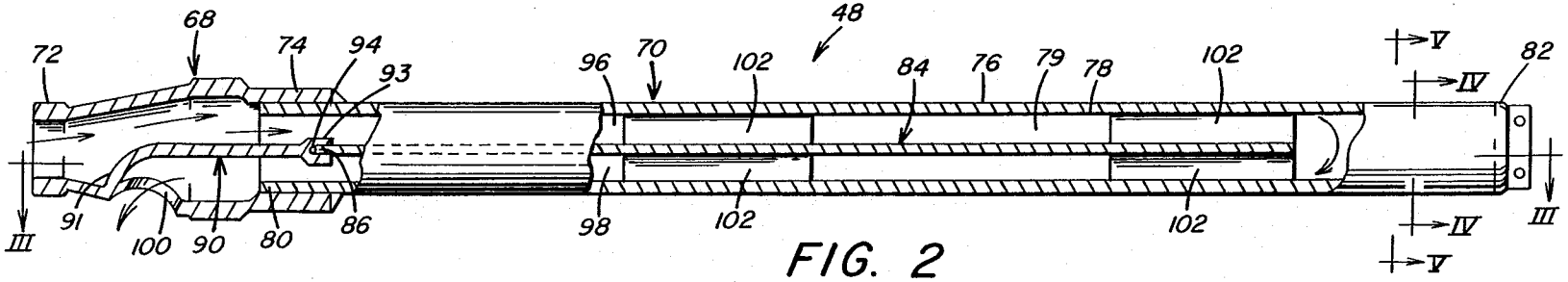
FIG. 2 is a partial sectional, top plan view of a rabble arm which is the subject of this invention, illustrating an elongated tubular member connected to a socket member.
Figure 3:
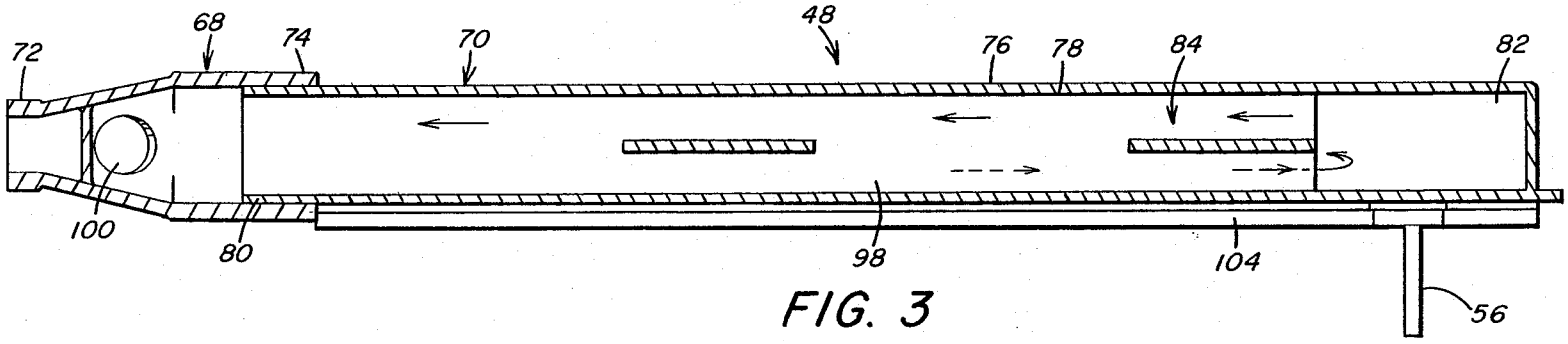
FIG. 3 is a sectional view in side elevation of the rabble arm taken along line 3—3 of FIG. 2.

Referring to FIGS. 2 and 3, the improved rabble arm 48 includes a socket member 68 and a tubular member 70. The socket member 68 has an open end portion 72 adapted to be connected to center shaft 28 of multiple hearth furnace 10, and an open end portion 74 connected by suitable means to tubular member 70. As will be described later in greater detail, socket member 68 end portion 74 has a cross-sectional configuration substantially conforming to the cross-sectional configuration of tubular member 70. Although not illustrated, the socket member 68 may include an upwardly offset end portion to provide the desired height of the tubular member 70 above the furnace hearth.

Tubular member 70 has an outside surface 76 and an inside surface 78 arranged to form a hollow interior portion 79 which extends longitudinally from tubular member open end portion 80 to tubular member closed end portion 82. A partition 84 in the form of a plate member is positioned within the hollow interior 79 of tubular member 70. Partition 84 has an end portion 86 connected to partition member 90 of socket 68. As seen in FIG. 2, socket 68 partition member 90 has an end portion 91 connected to a side wall of socket 68, and an opposite end portion 93 having a slotted portion 94 for receiving the end portion 86 of tubular member 70 partition 84. The partition 84 positioned within tubular member 70 has an opposite end portion 88 spaced from the closed end portion 82 of tubular member 70. Socket 68 partition member 90 and tubular member 70 partition 84 form a pair of chambers 96, 98 each opening into the closed end portion 82 of tubular member 70. It should be understood that partition plates 84 and 90 could be tubular members and function in a similar manner. A cooling medium, such as cooling air, is introduced into socket 68 open end portion 72 to circulate through chambers 96 and 98 and thereafter exit socket 68 at outlet opening 100.

As described, air is circulated through the hollow interior 79 of rabble arm 48 to cool the outside and inside surfaces 76, 78 of tubular member 70 and prevent rabble arm 48 from experiencing both sagging deformation in a vertical direction due to the elevated temperatures within multiple hearth furnace 10 as a plurality of rabble teeth 56 secured to tubular member 70 convey material along a given hearth within furnace 10. As further seen in FIG. 2, a plurality of spacer members 102 may be positioned within the hollow interior 79 of tubular member 70 to extend between partition 84 and tubular member inside surface 78 to secure partition 84 in fixed position within hollow interior 79.

As seen in FIG. 3, a retaining member 104 is secured by suitable means, such as welding, to the outside surface 76 of tubular member 70. Retaining member 104 extends from a position adjacent the end portion 74 of socket member 68 to tubular member 70 closed end portion 82. As known in the art, retaining member 104 may have any desired cross-sectional configuration (not shown) for receiving a plurality of rabble teeth 56 (one shown). For example, retaining member 104 may have a dove tail cross-sectional configuration for receiving a plurality of longitudinally positioned rabble teeth, or may have a configuration as illustrated in FIG. 3 for receiving a plurality of clevis connecting-type rabble teeth (not shown). In addition, although retaining member 104 is illustrated in FIG. 3 as extending from a location adjacent socket member 68 end portion 74 to the closed end portion 82 of tubular member 70, it should be understood that a plurality of short retaining members 104 may be longitudinally spaced from each other and secured to tubular member 70 outside surface 76.

Figure 5:
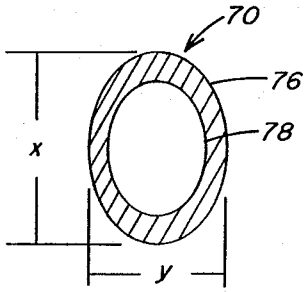
FIG. 5 is a cross-sectional end view of a rabble arm taken along a section line similar to line 4—4 of FIG. 2, illustrating another specie of the rabble arm tubular member having a generally circular inside surface and a generally oval outside surface.
Figure 4:
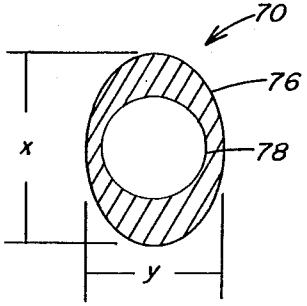
FIG. 4 is a cross-sectional end view of the rabble arm taken along line 4—4 of FIG. 2, illustrating the rabble arm tubular member having generally oval inside and outside surfaces.

Referring to FIGS. 4 and 5, there are illustrated alternate cross-sectional configurations of tubular member 70 used to form the improved rabble arm 48. It has been found that providing tubular member 70 with a cross-sectional configuration as illustrated in either FIGS. 4 or 5 not only increases the resistance to bending or sagging of tubular member 70 in a vertical direction when subjected to the elevated temperatures within furnace 10 over an extended period of time.

As seen in FIG. 1, each rabble arm 48 is connected to center shaft 28 in cantilever fashion and carries a plurality of rabble teeth 56. The weight to the rabble arm and rabble teeth tend to cause the rabble arm to sag or bend as the arm is subjected to elevated temperatures for an extended time period. However, by providing tubular member 70 with a cross-sectional configuration as illustrated in either FIGS. 4 or 5, this tendency of the rabble arm to sag or bend is greatly reduced.

Tubular member 70 may be formed by any suitable means known in the art to provide that tubular member 70 outside surface 76 has an oval or elliptical cross-sectional configuration. It should be understood that the configuration of the outside surface 76 is preferred to be elliptical it is not intended to be limited to the specific geometric definition of an ellipse and other oval configurations which provide substantially the same results may be used. The terms oval and elliptical will be used interchangeably throughout the specification. Tubular member 70 inside surface 78 has either a generally circular or oval/elliptical cross-sectional configuration. Preferably, tubular member is formed to provide that outside surface 76 has an elliptical cross-sectional configuration. As seen in FIGS. 4 and 5, the oval or elliptical cross-sectional configuration of tubular member outside surface 76 defines a major axis x and a minor axis y angularly displaced from major axis x by approximately 90° . Since the outside surface 76 of tubular member 70 has an elliptical cross-sectional configuration, the major axis x has a length which is greater than the length of minor axis y. Rabble arm 48 is adapted to be connected to center shaft 28 of multiple hearth furnace 10 so that the major axis x of elliptical tubular member 70 is positioned substantially vertically and minor axis y is positioned substantially horizontally. Since each rabble arm 48 is connected to center shaft 28 in cantilever fashion, positioning a rabble arm 48 formed from tubular member 70 so that major axis x lies substantially vertically will force any bending of tubular member 70 to take place about tubular member minor axis y. However, since tubular member 70 has an elliptical cross-sectional configuration to define a major axis x having a length greater than a length of minor axis y, bending of rabble arm 48 tubular member 70 about minor axis y at elevated temperatures is greatly reduced due to the high section modulus of the elliptical member which provides a correspondingly high weight carrying capacity.

A rabble arm 48 which utilizes a tubular member 70 having an elliptical outside surface 76 and connected to center shaft 28 with the major axis x of tubular member 70 lying substantially vertically increases the resistance to bending stresses of this rabble arm over rabble arms previously used. If desired, the rabble arm 48 illustrated in FIGS. 2–5 can be further strengthened by making the material from which tubular member 70 is formed bimetallic. A high strength alloy material may be utilized to first cast the outer exposed surface of the tubular member, and thereafter the remainder of the arm may be cast using a lower strength material.

Tubular member 70 may be formed by any suitable means known in the art. For example, tubular member 70 may be provided with an oval, preferably elliptical, outside surface 76 by pressing a round, centrifugally cast tube to oval or elliptical shape. If a round cast tube having a uniform wall thickness is pressed to oval or elliptical shape, the tubular member will have a cross-sectional configuration as illustrated in FIG. 4. If desired, tubular member 70 may be cast by methods known in the art to provide an oval or elliptical cross-sectional outside wall 76 and a circular cross-sectional inside wall 78 as illustrated in FIG. 5.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A rabble arm adapted arm adapted for use in a multiple hearth furnace and being particularly adapted to withstand the stress caused by the thermal cycling of said furnace comprising, an elongated tubular member having an open end portion and an opposite closed end portion, said tubular member having an outside surface of substantially oval cross-sectional configuration and an inside surface arranged to form a tubular member hollow interior portion of substantially uniform cross-section throughout its length connected with said tubular member open end portion, socket means connected to said tubular member open end portion, said socket means having an inlet end portion adapted to be connected to a center shaft of said multiple hearth furnace and a tubular member connecting end position, said socket means tubular member connecting end portion having an oval cross-sectional configuration substantially conforming to the oval cross-sectional configuration of said tubular member outside surface for receiving said tubular member open end portion, said socket means having a hollow interior portion, said socket means hollow interior portion and said tubular member hollow interior portion each including partition means for forming a plurality of flow paths for receiving a cooling medium circulated through said socket means and said tubular member, said tubular member partition means being longitudinal partition means positioned within said hollow interior portion and extending from said tubular member open end portion to a location spaced from said tubular member closed end portion, said partition means forming a flow path for said cooling medium introduced into said hollow interior portion at said tubular member open end portion and circulated through said hollow interior portion, bracket means positioned longitudinally and secured to said tubular member outside surface, and a plurality of rabble teeth secured to said bracket means, each of said rabble teeth extending radially from said tubular member outside surface.

2. A rabble arm adapted for use in a multiple hearth furnace as set forth in claim 1 in which, said oval cross-sectional configuration of said tubular member outside surface defines an ellipse having a major axis and a minor axis displaced from said major axis by 90° , said major axis having a length greater than a length of said minor axis, and said socket means with said tubular member connected thereto is adapted to be secured to a vertically extending center shaft of a multiple hearth furnace so that said tubular member is cantilevered to said center shaft with said major axis of said elliptical cross-section tubular member positioned substantially vertically and said minor axis of said elliptic cross-section tubular member positioned substantially horizontally.

3. A rabble arm adapted for use in a multiple hearth furnace as set forth in claim 1 in which, said tubular member outside surface has a substantially oval cross-sectional configuration and said tubular member inside surface has a circular cross-sectional configuration to define a tubular member with a wall having a non uniform cross-sectional thickness.

4. A rabble arm adapted for use in a multiple hearth furnace as set forth in claim 1 in which, said tubular member inside surface has a substantially oval cross-sectional configuration.

5. A rabble arm adapted for use in a multiple hearth furnace as set forth in claim 1 in which, said tubular member inside and outside surfaces define a tubular member wall, and said tubular member wall has a substantially uniform cross-sectional thickness.

* * * * *